US010279991B2

(12) United States Patent
Roger et al.

(10) Patent No.: US 10,279,991 B2
(45) Date of Patent: May 7, 2019

(54) RIGID REFRIGERATED OFFSHORE SHIPPING CONTAINER

(71) Applicants: Robert Roger, Houma, LA (US); Lindsey Roger, Houma, LA (US); Albert Olsen, Houma, LA (US)

(72) Inventors: Robert Roger, Houma, LA (US); Lindsey Roger, Houma, LA (US); Albert Olsen, Houma, LA (US)

( * ) Notice: Subject to any disclaimer, the term of this patent is extended or adjusted under 35 U.S.C. 154(b) by 0 days.

(21) Appl. No.: 15/093,958

(22) Filed: Apr. 8, 2016

(65) Prior Publication Data

US 2016/0297606 A1 Oct. 13, 2016

Related U.S. Application Data

(60) Provisional application No. 62/145,566, filed on Apr. 10, 2015.

(51) Int. Cl.
*B65D 88/74* (2006.01)
*B65D 90/00* (2006.01)

(52) U.S. Cl.
CPC ..... *B65D 88/744* (2013.01); *B65D 90/008* (2013.01); *B65D 90/0033* (2013.01)

(58) Field of Classification Search
CPC .. B65D 88/744; B65D 9/0033; B65D 90/008; B65D 90/0066; B65D 88/32; B65D 90/587; B65D 88/74; B65D 90/16; B65D 88/02; B65D 88/121; B65D 88/52; B65D 88/522; B65D 88/524
USPC ..... 62/372
See application file for complete search history.

(56) References Cited

U.S. PATENT DOCUMENTS

| | | | | |
|---|---|---|---|---|
| 2,631,439 | A | 3/1853 | Feigenbauum | |
| 4,294,079 | A | 10/1981 | Benson | |
| 5,473,908 | A | 12/1995 | Saia, III et al. | |
| 5,671,611 | A | 9/1997 | Quigley | |
| 6,044,650 | A | 4/2000 | Cook et al. | |
| 6,381,981 | B1 * | 5/2002 | Yaddgo | F25D 3/125 62/372 |
| 7,028,504 | B2 | 4/2006 | Derifield | |
| 2007/0289976 | A1 * | 12/2007 | Meyer | F25D 11/003 220/592.09 |

(Continued)

FOREIGN PATENT DOCUMENTS

| | | |
|---|---|---|
| EP | 0711965 | 5/1989 |
| GB | 345776 | 2/1929 |
| WO | 9215507 | 12/2009 |

*Primary Examiner* — Ana M Vazquez

(57) ABSTRACT

A refrigerated stainless steel shipping container for use in transporting and holding perishable foods in a refrigerated or frozen condition for offshore oil and gas and marine industries. The shipping container is comprised of an exterior box encasing an interior box enclosing a food refrigeration chamber. Spaced apart exterior and interior walls on the interior box create compartments for cooling material such as dry ice. Cooling material is selectively placed in the cooling compartments to control the temperature in the refrigeration chamber without electricity or other external power source. The cooling compartments are vented to the outside of the cooling container to avoid exposure of the refrigeration chamber to gases produced by dissipating cooling material. The shipping container is skid mounted and has lifting lugs for attachment to lifting slings.

3 Claims, 12 Drawing Sheets

(56) References Cited

U.S. PATENT DOCUMENTS

| | | | | |
|---|---|---|---|---|
| 2009/0184112 | A1* | 7/2009 | Nielsen | B65D 88/121 220/1.5 |
| 2013/0008188 | A1* | 1/2013 | McCormick | F28D 15/0275 62/53.2 |
| 2014/0021690 | A1* | 1/2014 | Burd | B62B 3/003 280/47.35 |

* cited by examiner

Desired Temperature (DT°) of Refrigeration Chamber 24

50

| BIN | Quantity of Cooling Material (36) |
|---|---|
| A, C, O, M | X LBS. |
| F, H, J, R, T, V | Y LBS. |

*Fig.14*

RIGID REFRIGERATED OFFSHORE SHIPPING CONTAINER

PRIORITY

This application claims priority to U.S. provisional application Ser. No. 62/145,566 filed Apr. 10, 2015 entitled "Rigid Refrigerated Offshore Shipping Container", the entire content of which is incorporated by reference.

FIELD OF INVENTION

This invention relates to refrigerated containers and more particularly, to a rigid refrigerated shipping container for use in transporting perishable, foods to offshore oil and gas drilling and production installations.

BACKGROUND OF THE INVENTION

Offshore oil and gas drilling and production installations such as platforms, drill ships, and drilling barges typically have kitchen and commissary facilities used to store and prepare food to feed the workers housed at these drilling and production installations. Food and commissary supplies are typically packed into shipping containers and delivered to these offshore installations by supply boats and moved from the supply boat to the offshore installation by means of a crane or other lifting mechanism.

Perishable foods are delivered in insulated shipping containers. Such perishable foods and beverages may include fresh vegetables, meats, and dairy products that require refrigeration or frozen foods that must be kept frozen in order to prevent spoilage. These insulated containers are loaded with a cooling medium such as ice or ice substitutes to keep the perishable foods cold. Such insulated shipping containers are often loaded with food boxes and the cooling medium and then left on loading docks to be subsequently loaded on a vessel and transported to the offshore location. Often containers loaded with perishable foods are left on loading docks for extended periods of time due to shipping delays that may be cause by the vagaries of weather or other contingencies or under adverse conditions such as elevated temperatures caused by prolonged exposure in hot sunny locations. These situations cause the ice or other cooling medium in the shipping containers to melt or warm to cause the food in the containers to warm and spoil. Shipping containers with perishable foods ma be damaged by dynamic loads during shipping and handling resulting in lost or contaminated foods.

Consequently, there is a need for a refrigerated shipping container for shipping perishable foods to offshore oil and gas locations that will maintain a desired temperature for the foods being shipped and that will withstand the rigors of loading and shipping that often occur in an offshore environment.

SUMMARY OF THE INVENTION

A rigid shipping container used for transporting and holding fresh and frozen foods in a refrigerated or frozen condition over extended time periods is disclosed. The container is comprised of exterior box having a spaced apart exterior and interior walls. Within the exterior box of the container is an interior box having spaced apart interior and exterior walls that encase a refrigeration chamber for holding a quantity of perishable foodstuff. The spaced apart exterior and interior walls of the interior box create interconnected cooling compartments for holding a quantity of cooling material utilized to create a refrigerated environment within the refrigeration chamber sufficient to preserve stored foodstuff. The cooling material, preferable solidified carbon dioxide ($CO_2$) or dry ice, serves as the refrigerant for the food refrigeration chamber.

The cooling compartments have an access opening with a sealed door to allow introduction of the cooling material. At least one of the exterior sidewalls has a hinged door providing access into the refrigeration chamber. The dry ice cooling material is manually loaded in the cooling compartments which are then sealed. As the dry ice in the ice compartments sublimates, the refrigeration chamber is kept cold b the circulation of radiant air in the interconnected cooling compartments around the refrigeration chamber. This eliminates the need for generators, electrical power sources, or fuel. The cooling compartments are provided with vents to allow the sublimating dry ice to be vented to the atmosphere outside the shipping container so that the food refrigeration chamber is not exposed to $CO_2$ gasses from the dry ice.

The temperature within the refrigeration chamber is maintained and regulated by the arrangement and amount of dry ice placed in the cooling compartments. This allows the shipping container to be used as a refrigerator to keep perishable foods cool or as a freezer to freeze and maintain frozen foods at a suitable temperature.

The shipping container requires no electricity, compressor, motor, or other external or internal power source is required for maintaining a desired temperature in the refrigeration chamber. Refrigeration without external or internal power sources reduces the risk of exposing refrigerated foodstuffs to fuel or other contaminents.

The shipping container is fabricated from stainless steel for strength, cold conduction and retention, and corrosion resistance. Preferably the container will be fabricated with food grade stainless steel and other materials. The container is mounted on a pallet-style base frame or skid. The exterior of the container has lifting lugs for attachment of wire rope slings. The skid is provided with openings for receiving the tines of a forklift.

The container, skid, and lifting lugs are designed to comply with the standards for shipping containers established by Shell Exploration and Production Company, the SEPco standards, which are widely utilized and accepted standards for shipping containers for use in the offshore oil and gas industry operating in the Gulf of Mexico. The containers also comply with the DNV GL standards for shipping container that are utilized worldwide in the marine and oil and gas industries. The container and skid may be sized as a single or a double pallet container as desired.

The shipping container is principally intended for use in the offshore oil and gas exploration and production industry for transporting perishable foods by boat or other vessel. The shipping container may also be utilized for onshore shipping purposes such as b rail or by truck. Use of the shipping container will allow seafood, such fresh fish oysters, and shrimp, dairy products, such as milk, butter, or ice cream, or produce to be transported and maintained in a refrigerated or frozen condition as may be required without the need for refrigerated vehicles or vessels or other external refrigeration.

BRIEF DESCRIPTION OF THE DRAWINGS

FIG. 14 is a mock-up for a loading diagram for loading the bins labeled as shown in FIG. 13 to achieve a desired temperature.

DESCRIPTION OF THE EMBODIMENT

Figure 1:
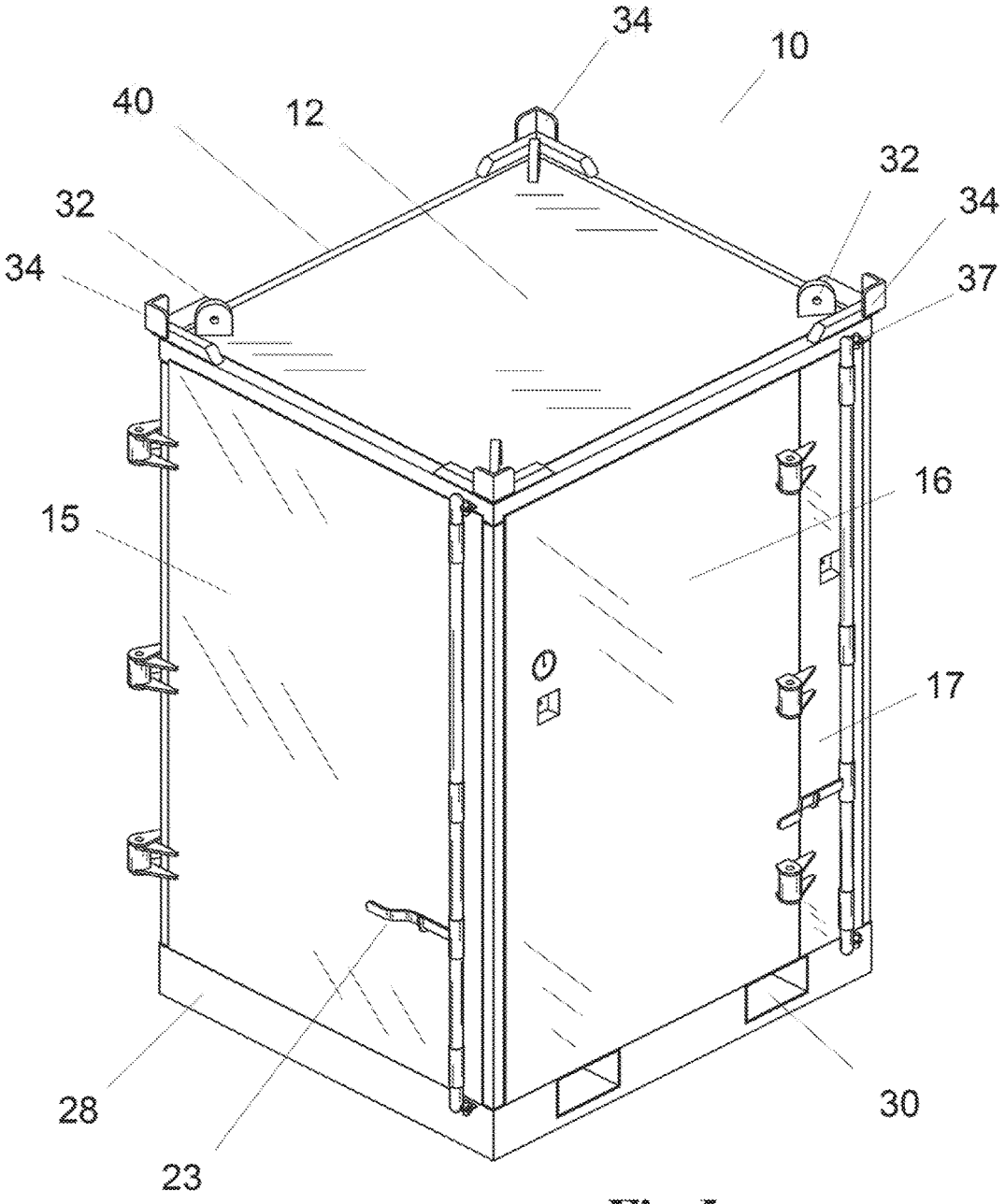
FIG. 1 is an isometric view of the refrigerated shipping container described herein.
Figure 2:
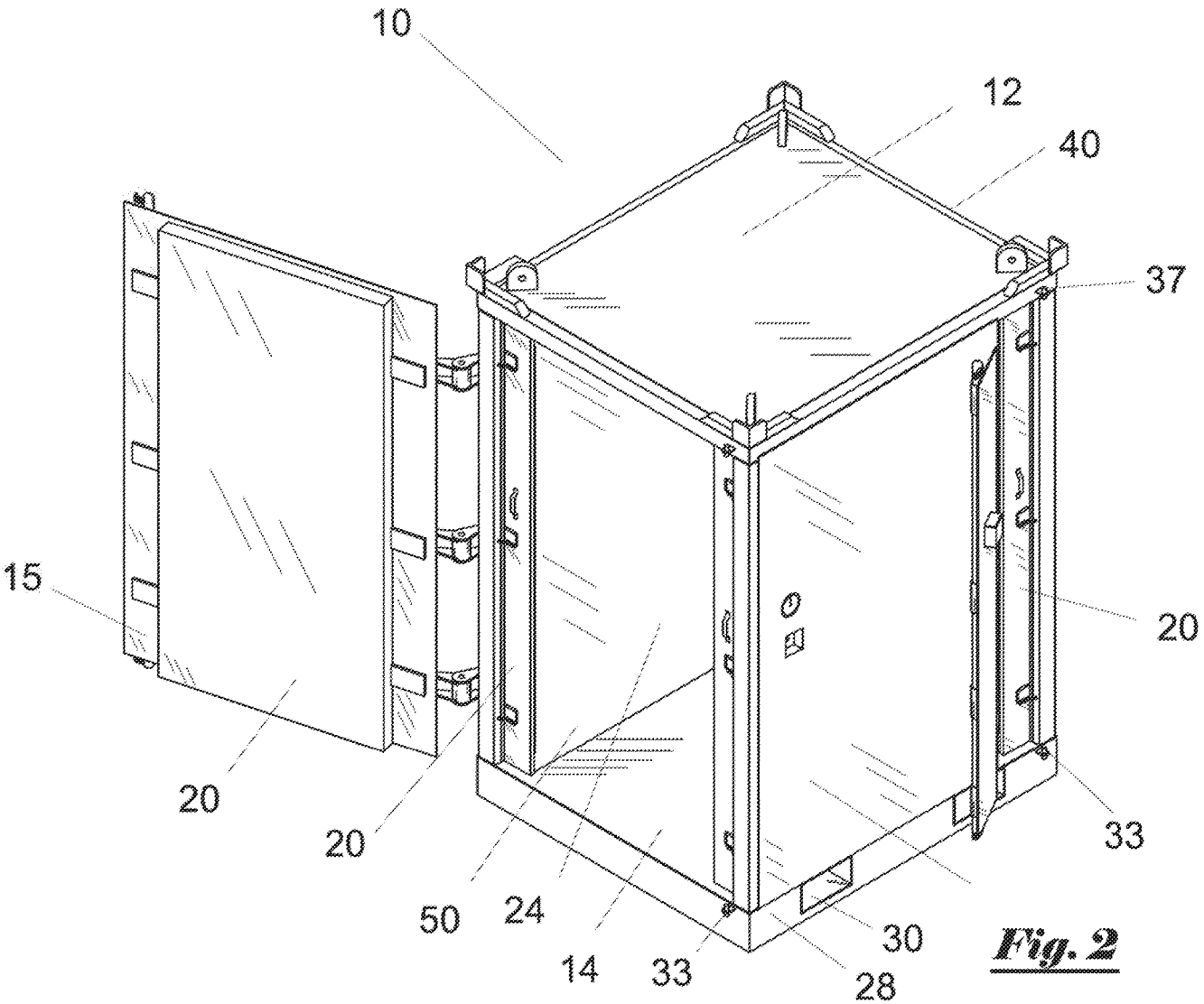
FIG. 2 is an isometric view of the shipping container of FIG. 1 with the container door open.
Figure 3:
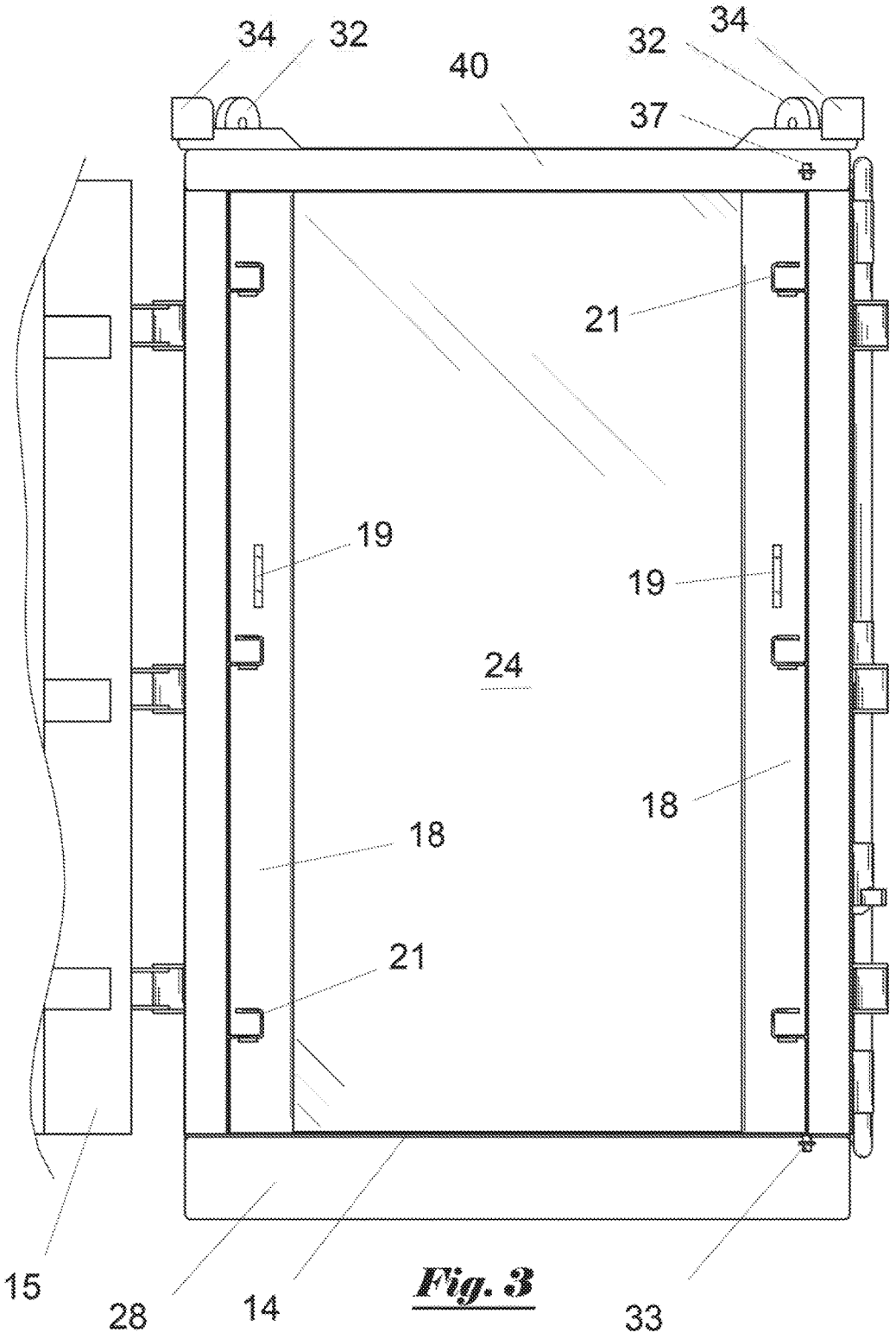
FIG. 3 is a front elevation view of the shipping container of FIG. 1 with the container door open.
Figure 4:
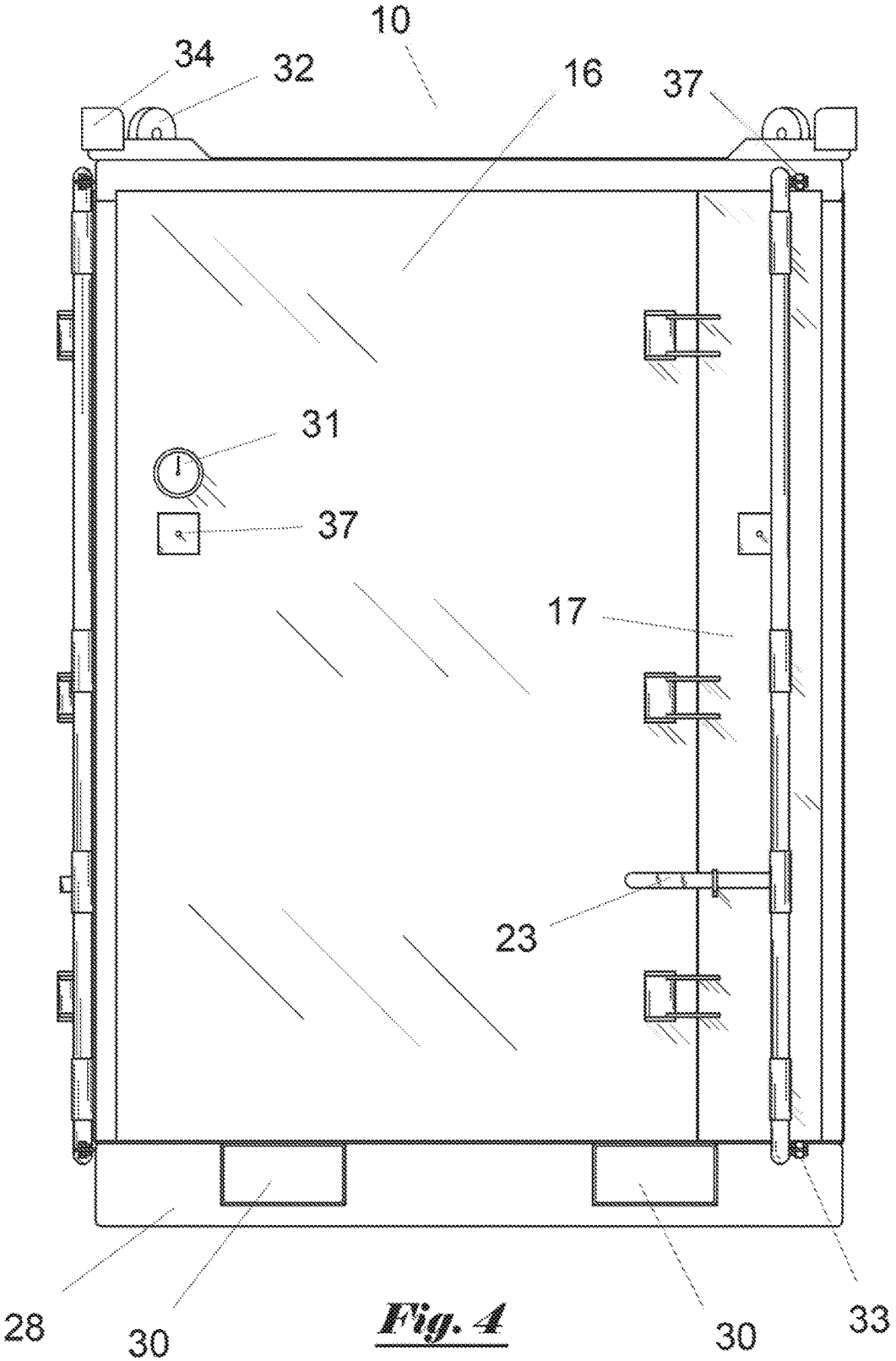
FIG. 4 is a front elevation view of the shipping container of FIG. 1 with the container door closed.

The refrigerated shipping container 10 is shown in FIGS. 1-11. The container 10 is comprised of exterior box 40 having a top 12, a bottom 14, spaced apart exterior box walls 16 and 16A, a hinged exterior container door 15 that also serves as an exterior wall. Latches 23 secure the exterior container door 15 in an airtight closed position.

Figure 5:
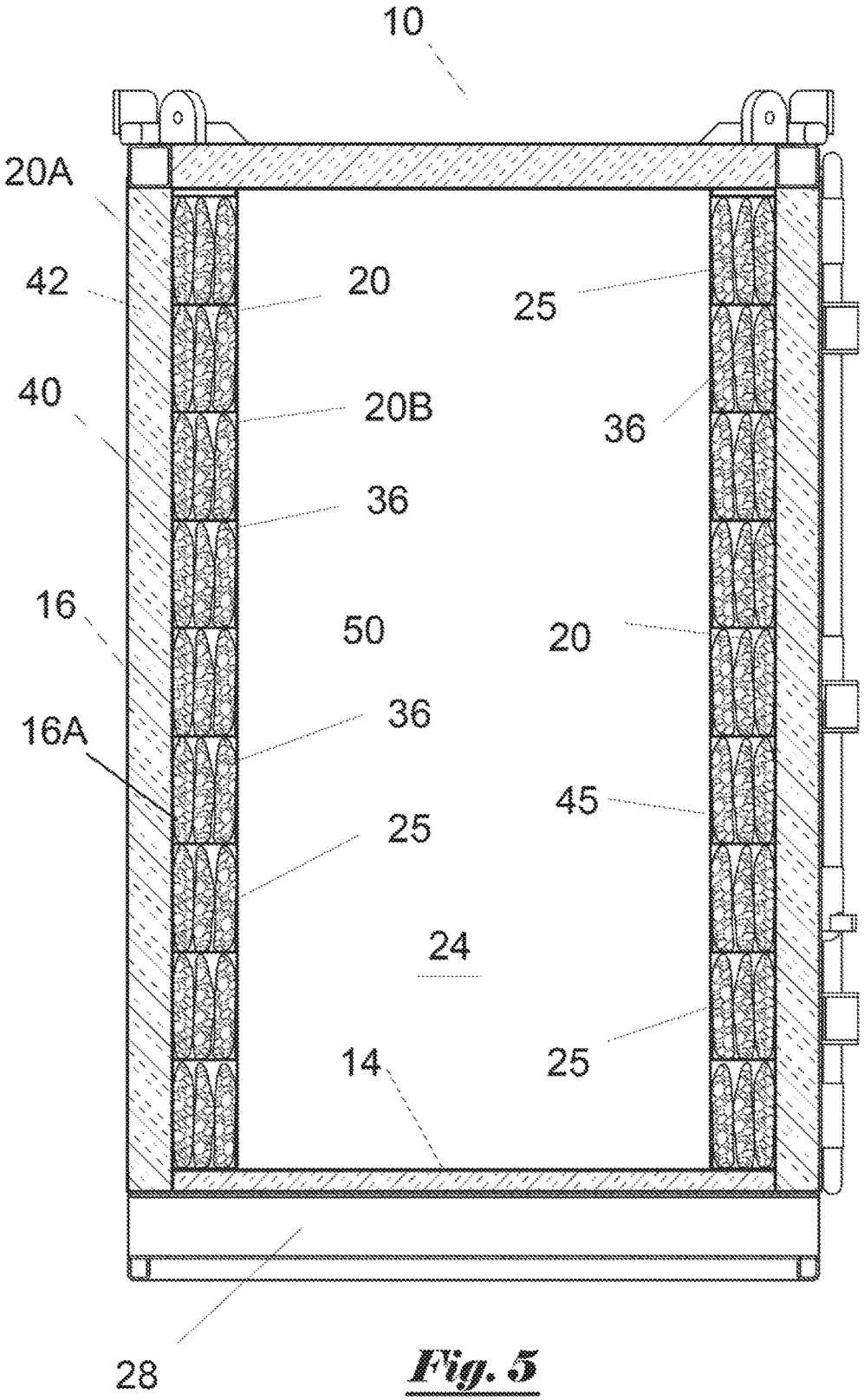
FIG. 5 is a cross-section elevation view of the shipping container of FIG. 1 showing the refrigeration chamber and the cooling compartments with inserted cooling material.
Figure 6:
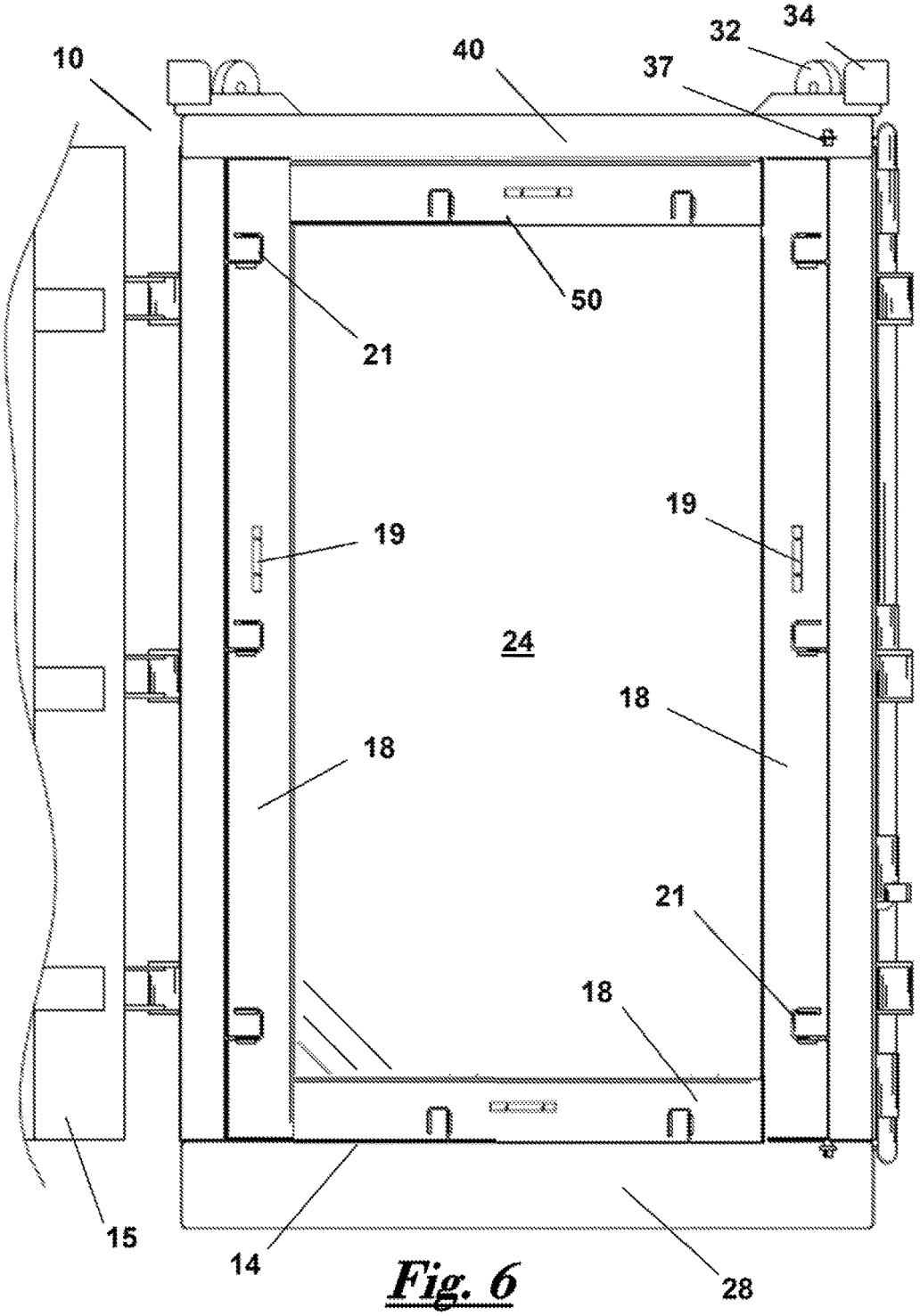
FIG. 6 is a front elevation view of another embodiment of the shipping container of FIG. 1 with cooling compartments on the top, bottom, and sides of the refrigeration chamber.
Figure 7:
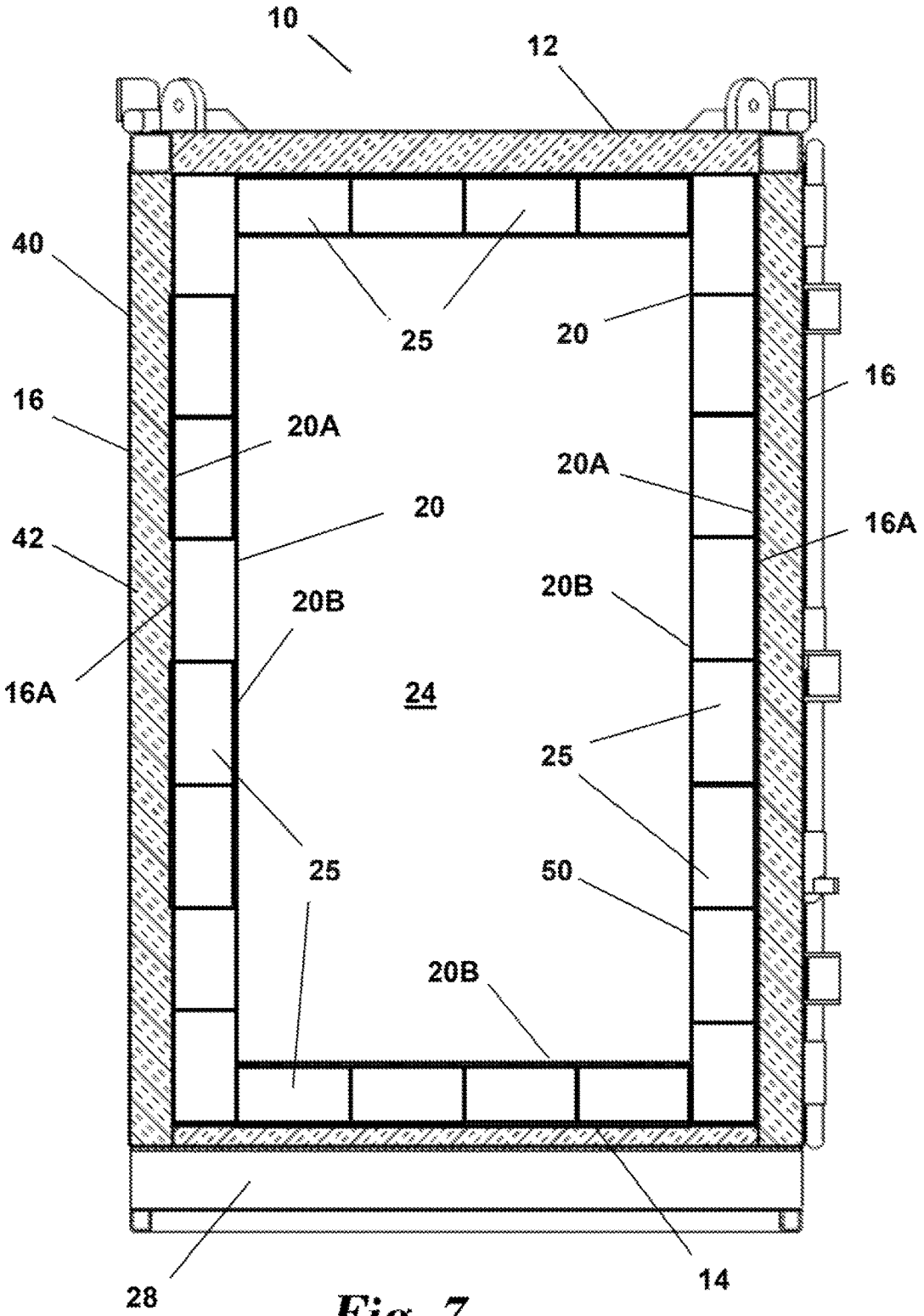
FIG. 7 is a front elevation view of the shipping container of FIG. 6 showing the refrigeration chamber, cooling compartments, and cooling bins
Figure 8:
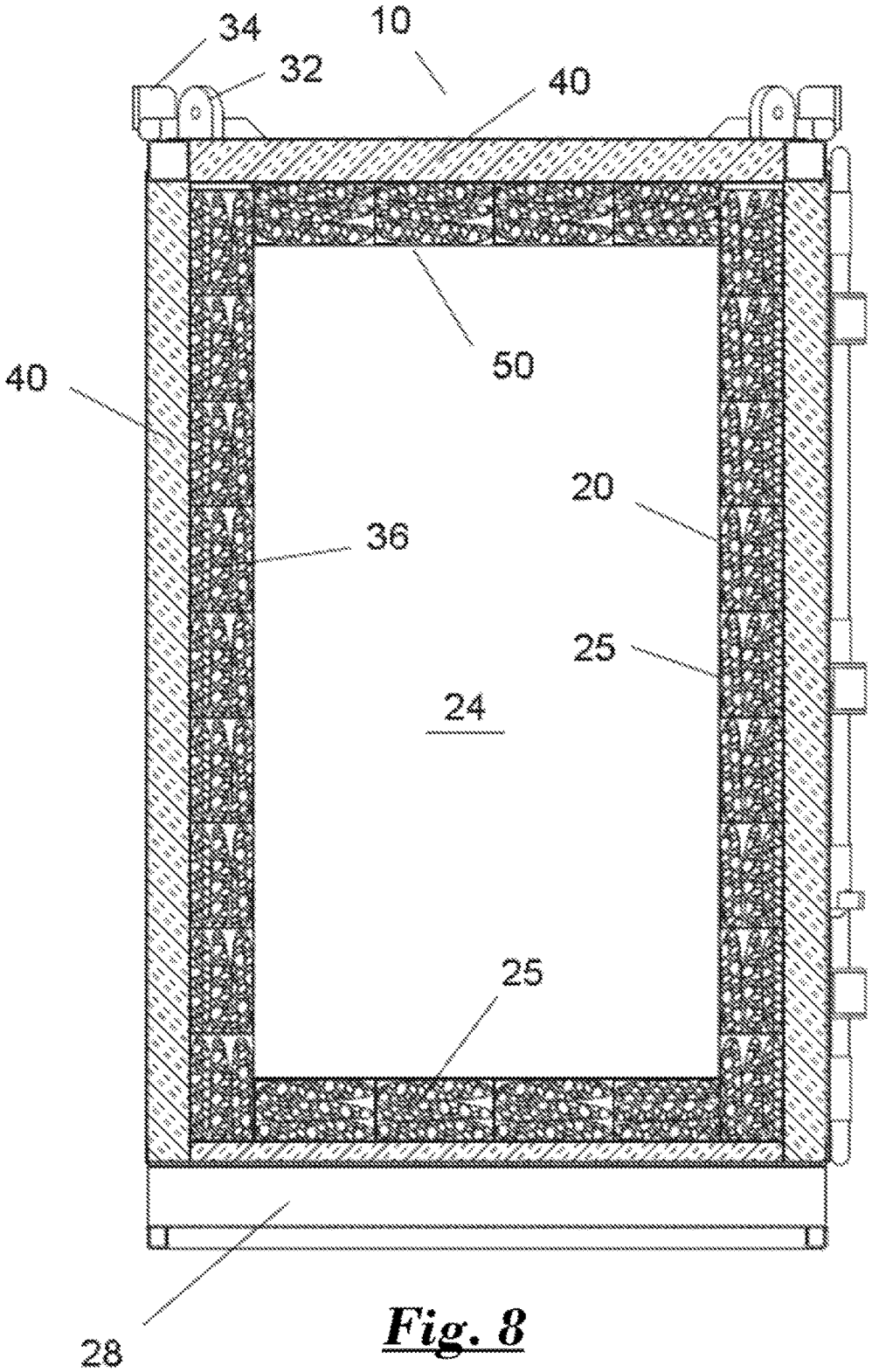
FIG. 8 is an elevation cross-section view of the shipping container of FIG. 6 showing the refrigeration chamber and cooling compartments with cooling material.
Figure 9:
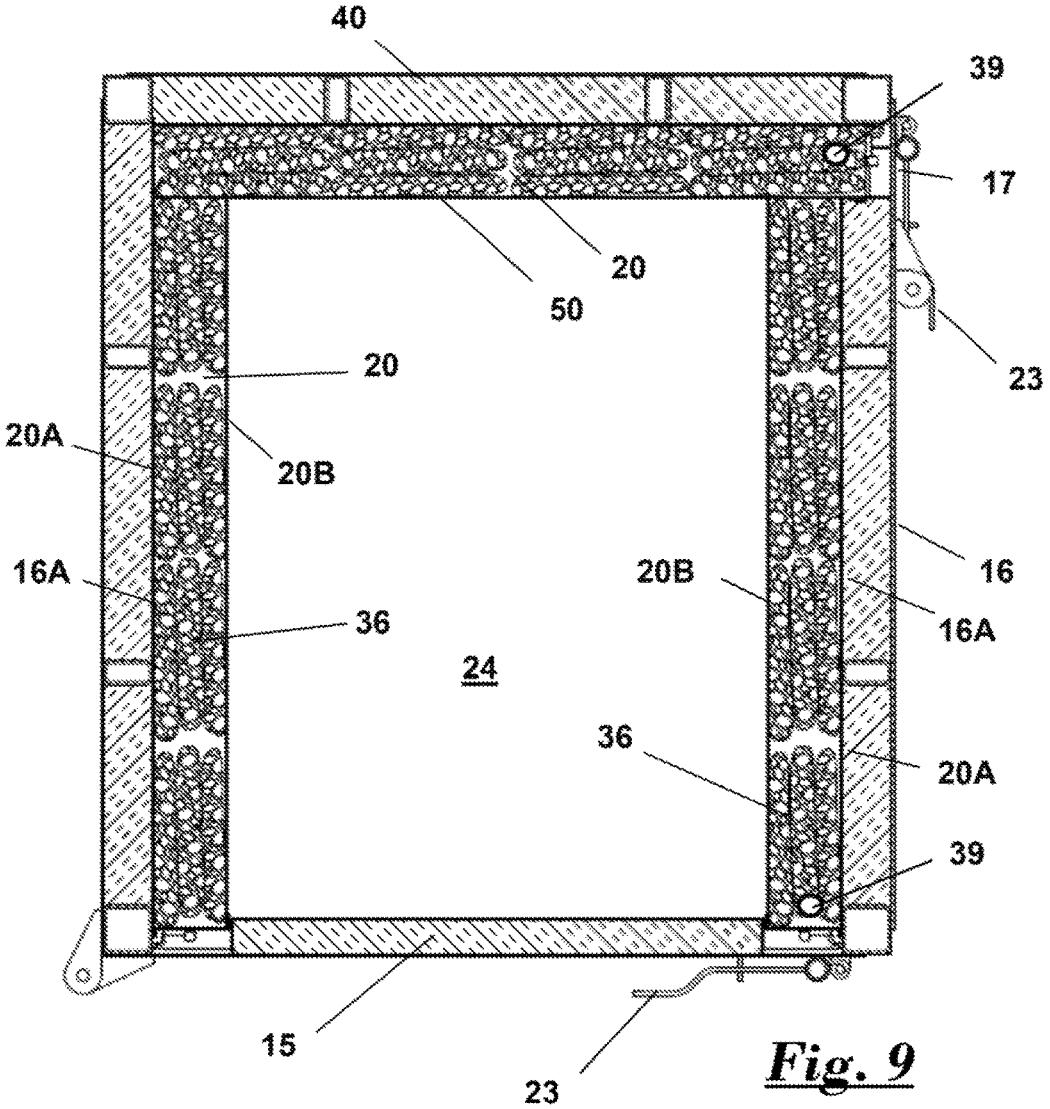
FIG. 9 is a top cross-section view of the shipping container of FIG. 1.
Figure 11:
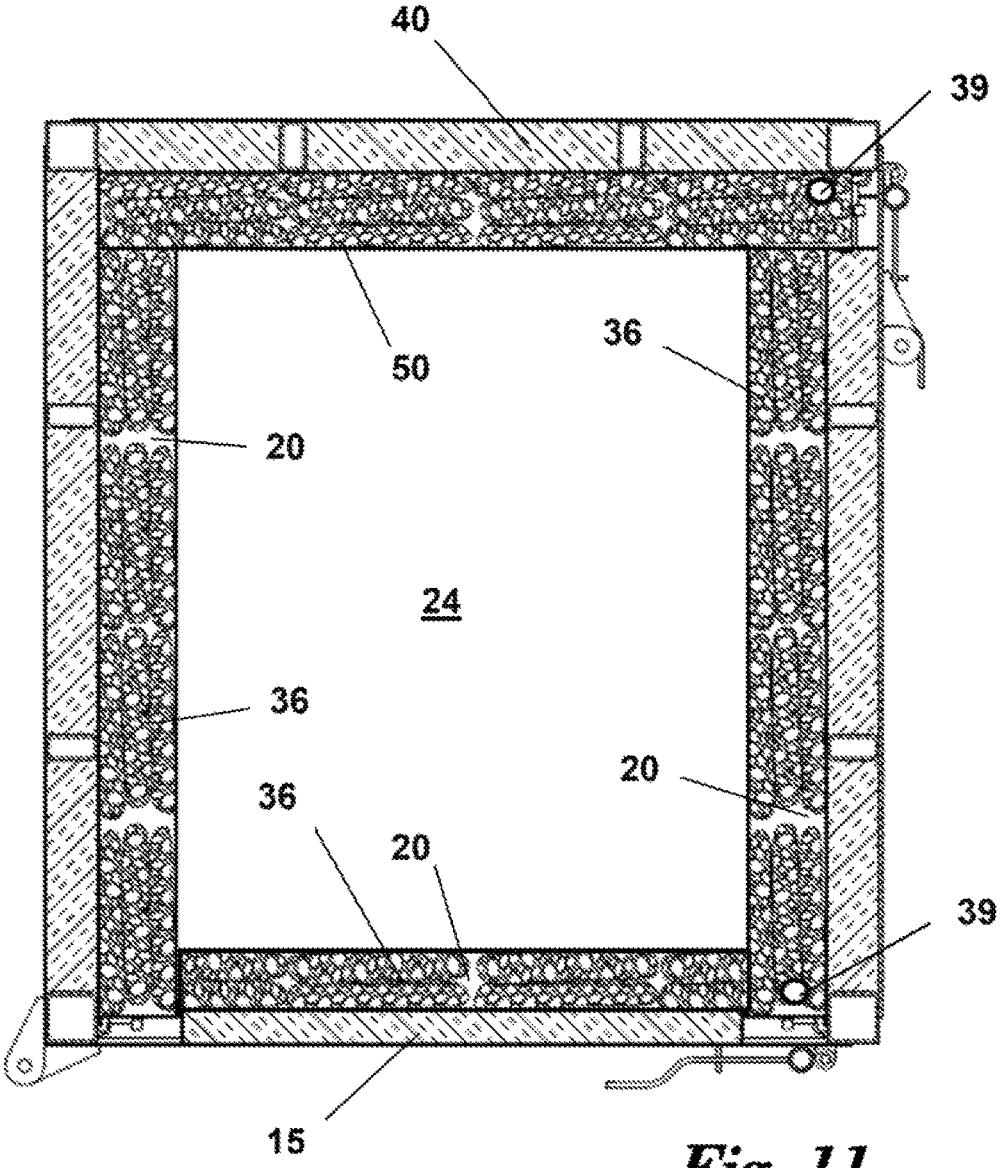
FIG. 11 a top cross-section view of the shipping container showing cooling compartments on container door of the refrigerated shipping container of FIG. 6.

The exterior box 40 encases an interior box 50 comprising interconnected cooling compartments 20 having spaced apart exterior and interior walls 20A and 20B, respectively. The cooling compartments may be placed only on the sides of the interior box 50, as shown in FIGS. 5 and 8. The cooling compartments 20 may also be placed on sides, top, and bottom of the interior box as shown in FIGS. 6, 7 and 8. Cooling compartments 20 may also be mounted on the exterior container door 15, as shown in FIG. 11, to seal and provide additional cooling for refrigeration chamber 24. The cooling compartments 20 may have a plurality of individual shelves or cooling bins 25. The individual cooling bins 25 allow for ease in selectively placing cooling material 36 within the cooling compartments 20 in order to regulate the cooling temperature within the refrigeration chamber 24.

Figure 12:
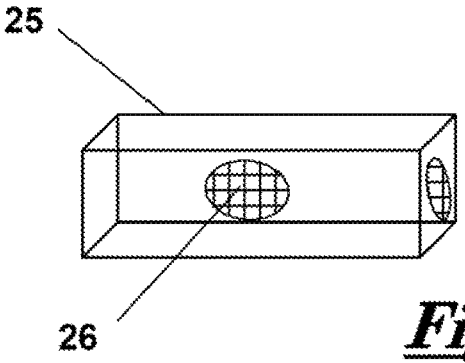
FIG. 12 shows an embodiment of a cooling compartment bin.

The cooling bins 25 will preferable be removable to allow adaption to a selected cooling material 36 and will preferably be formed from stainless steel for resistance to corrosion and low temperature but materials may be utilized for the bins 25 such as aluminum, aluminum alloys, plastics, HDPE, other polymers, or polymer coated metals. One embodiment of bin 25 is shown in FIG. 12 which is preferably comprised of a stainless steel frame covered by a stainless steel screen 26.

Figure 10:
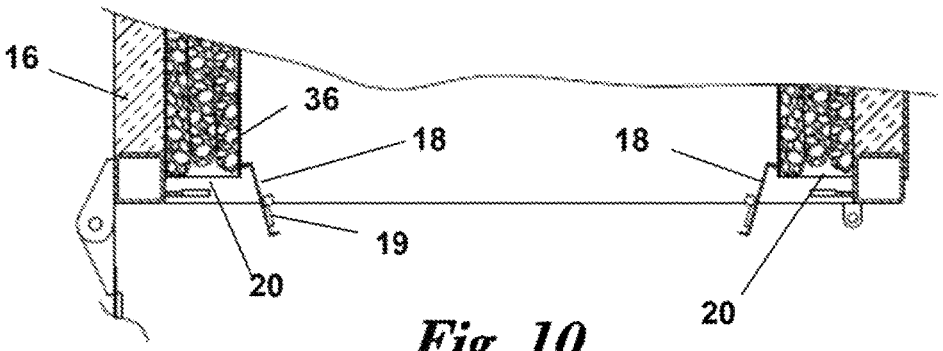
FIG. 10 is a partial top cross-section detail view of the shipping container of FIG. 1 showing the access doors to the cooling compartments.

The cooling compartments 20 are closed by a hinged interior access door 18 shown in detail in FIG. 10. Handles 19 allow access doors 18 to be pulled open and closed. Latches 21 hold the access doors 18 in a closed position. The cooling compartment access doors 18 prevent shifting of the cooling material 36 when the container 10 is transported. Access to the cooling compartments 20 from the exterior of the shipping container 10 is provided through hinged exterior cooling compartment doors 17 also having a latch 23 for securing the doors 17 in an airtight closed position.

Valved floor drains 33 for fluids and condensation that may accumulate in the cooling compartments 20. The drains 33 allow cleaning fluids to be removed from the cooling compartments 20 after cleaning and also provide additional ventilation. Insulation 42 such as a polymer foam may be provided in the space between the spaced apart exterior box walls 16 and 16A to aid in controlling the temperature within the refrigeration chamber 24 of the interior box 50. A USDA approved barrier 45 such as a paint or polymer coating also ma be applied to seal the walls 20B of the refrigeration chamber 24.

The exterior box 40 of the shipping container 10 is mourned on a base frame or skid 28. The skid 28 is provided with spaced apart slots or openings 30 for receiving the tines of a fork lift to allow for ready transportation of the container 10. A plurality of pad eyes or lifting lugs 32 on the top 12 of the exterior box 40 is provided with for attachment of slings for lifting the container 10 by a hoist or crane. Support posts or brackets 34 are provided on the top 12 of the exterior box 40 at each corner to provide a support for stacking multiple containers 10.

The refrigeration chamber 24 is refrigerated by the circulation of the cooling radiant air in the interconnected cooling compartments 20 around the refrigeration chamber 24 as the dry ice 36 in each ice compartment wall sublimates from a solid to a gas. The interconnected cooling compartment 20 are vented to the atmosphere outside of the container 10 by vents 37 and vent piping 39 so that workers and the refrigeration chamber 24 and its contents are not exposed to $CO_2$ gasses from the sublimating dry ice cooling material 36. A temperature gauge 31 is provided for monitoring the temperature within the refrigeration chamber 24.

Preferably the cooling material 36 will be a frozen gas such as carbon dioxide ($CO_2$) or "dry ice" 36. The dry ice used as the cooling material 36 may be in the form of carbon dioxide "snow", solid carbon dioxide pellets, solid carbon dioxide blocks, and the like. The dry ice used as the cooling material 36 may be sprayed directing into the cooling compartments 20, inserted into the cooling compartments 20 as blocks or pellets, or placed into individual bags and then inserted into the cooling compartments 20.

For use, cooling material 36 is loaded into the cooling compartments 20 or into selected bins 25 of each cooling compartment 20. The cooling compartments 20 are then sealed by closing the compartment doors 18. It is thought that the container 10 will be sized to accommodate a quantity of dry ice cooling material 36 sufficient to maintain a −20° temperature within the refrigeration chamber 24 for at least three days. Adjusting the quantity and location of the cooling material 36 in the compartments 20 allows a user to regulate the temperature of the refrigeration chamber 24. This may be accomplished by placing the cooling material 36 into selected cooling compartments 20 of into selected bins 25 of the cooling compartments 20 to fill, or partially fill, desired compartments 20 with cooling material 36. Such temperature regulation allows container 10 to be used as a refrigerator to keep perishable foods cool or as a freezer to freeze and maintain frozen foods at a suitable temperature or temperature range until delivery at an offshore location.

Figure 13:
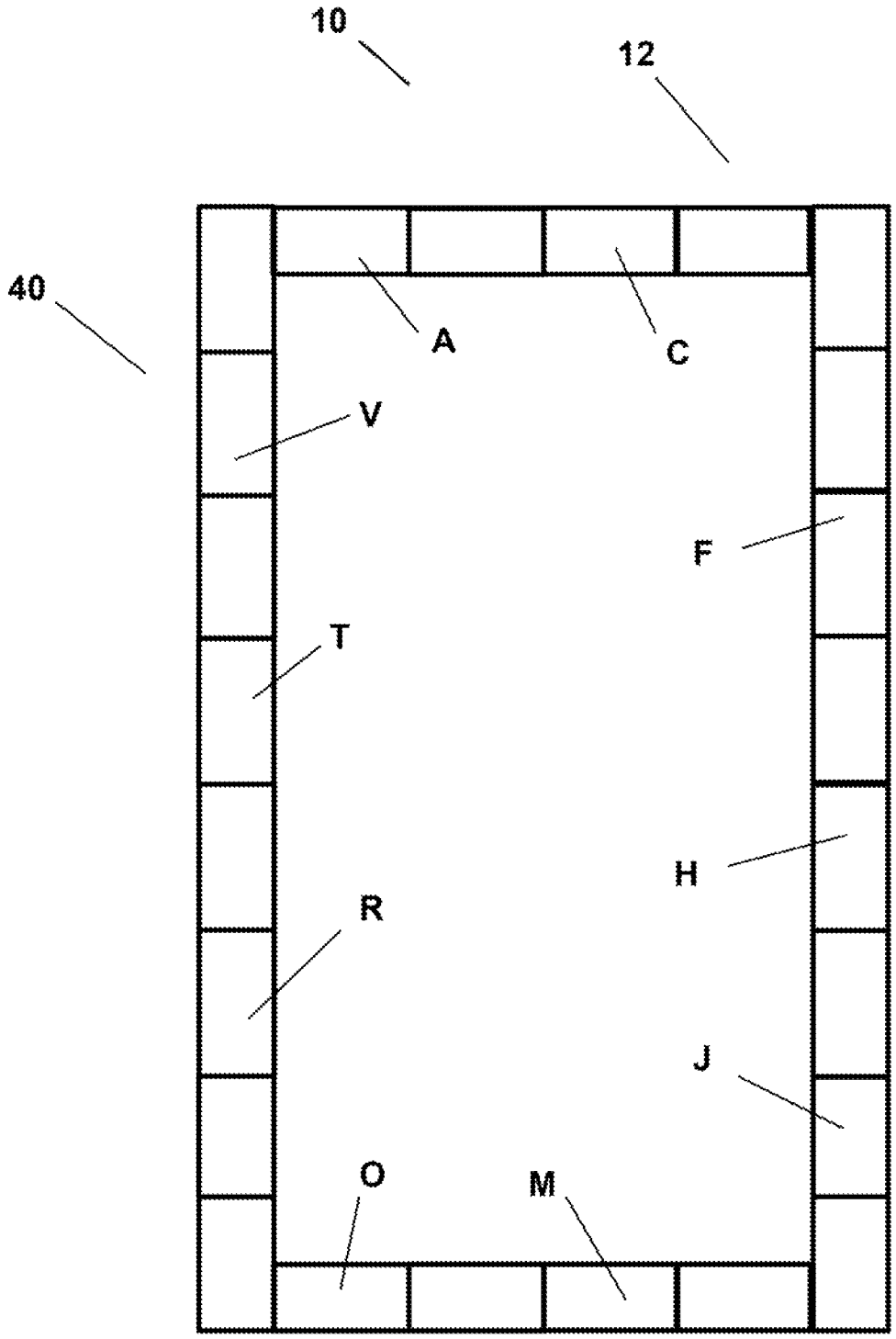
FIG. 13 is a diagram showing designating location of labeled bins.

The internal temperature of the refrigeration chamber 24 may be adjusted according to the products or foodstuff being shipped (i.e. frozen foods, dairy, produce, or meats) or to the shipment specifications of a user. The cooling compartments 20, and bins 25 if utilized, may be labeled with numbers or letters or otherwise designated for identification such as shown in FIG. 13. Such designated cooling compartments 20 may be coordinated with a corresponding loading diagram 50, such as the mock-up diagram shown in FIG. 14. Users may be provided with a plurality of such loading diagrams 50, each diagram 50 configured to provide the user with loading instructions for a shipping container 10 necessary for achieving a desired temperature in the refrigeration chamber 24. With such labeled cooling compartments and corresponding loading diagrams 50, a desired quantity of said cooling material 36 may be directed for placement in a specified cooling compartment 20 the cooling compartments 20, either directly on in bins 25, to produce a temperature in the refrigeration chamber 24 that is sufficient to preserve the perishables to be shipped in the shipping container 10.

For example, referring to FIGS. 13 and 14, a loading diagram 50 for a corresponding shipping container 10, provides directions to a user to load X-lbs. of cooling material 36 into bins A, C, O, and to load Y-lbs. of cooling material 36 into bins F, H, J, R, T, V of the shipping container 10 to achieve a desired temperature DT in the refrigeration chamber 24 where perishable foods or other perishables are stored. A plurality of diagrams 50 may be prepared for each size and configuration of shipping container 10 and for the temperature DT or temperature range desired.

Once the cooling compartments 20 are loaded with the desired quantity of dry ice cooling material 36, workers typically will never have to add additional cooling material 36, even on extended trips. This will reduce contact of workers with the cooling material. In the event a container 10 must retain stored foodstuffs for a prolonged period, the loss of cooling material 36 can be determined by weighing the container 10 and its contents and comparing that weight to its original shipping weight. If additional cooling material 36 is thought necessary, the cooling compartments 20 of the container 10 may be easily re-stocked by trained dry ice technicians at its location, whether a loading dock, in transport, or at its final destination.

The shipping container 10 may be provided in a variety of sizes depending upon the needs of a user. The construction of the shipping container 10 provides a thermal barrier on all six sides of the refrigeration chamber 24 to reduce the effect of external temperatures. Because hazardous chemicals or toxins are not used for refrigeration and there are no mechanical parts requiring fuel or fuel storage, the shipping container 10 and its use reduce the risk of contamination of the products carried in the refrigeration chamber 24 and presenting a negative impact on the environment.

The form of the container 10 described is presented merely as an example embodiment of the invention. It is thought that the refrigerated shipping container 10 presented herein, as well as its attendant advantages, will be understood from the foregoing description. Various changes may be made in the form, construction and arrangement of the parts of the refrigerated shipping container 10 without departing from the spirit and scope of the invention or sacrificing all of its material advantages.

We claim:

1. A shipping container for transporting and holding fresh and frozen foods in a refrigerated or frozen condition comprising:

(a) a skid;

(b) an exterior box mounted on said skid, said exterior box having sides, a top, and a bottom with spaced apart exterior and interior walls, and an exterior door;

(c) an interior box enclosed within said exterior box, said interior box having spaced apart exterior and interior walls creating interconnected cooling compartments and a refrigeration chamber;

(d) cooling material placed in said cooling compartments;

(e) a vent whereby said interconnected cooling compartments are ventilated to an outside of said exterior box;

(f) interior cooling compartment doors whereby said cooling compartments are opened and closed;

(g) a plurality of bins positioned within said cooling compartments;

(h) support posts on the top of said exterior box;

(i) lifting lugs mounted on an exterior of said exterior box;

(j) exterior cooling compartment doors allowing access to said interior cooling compartment doors; and (k) wherein said cooling material is selected from the group consisting of carbon dioxide snow, solid carbon dioxide pellets, and solid carbon dioxide blocks.

2. The shipping container recited in claim 1 wherein said cooling compartments are labeled.

3. The shipping container recited in claim 2 wherein said labels on said cooling compartments correspond to a loading diagram whereby a desired quantity of said cooling material is directed to said cooling compartments.

* * * * *